US011211240B1

(12) United States Patent
Kikuchi et al.

(10) Patent No.: US 11,211,240 B1
(45) Date of Patent: Dec. 28, 2021

(54) SHORT-ARC DISCHARGE LAMP

(71) Applicant: Ushio Denki Kabushiki Kaisha, Tokyo (JP)

(72) Inventors: Yasuro Kikuchi, Tokyo (JP); Takumi Yamane, Tokyo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/352,085

(22) Filed: Jun. 18, 2021

(30) Foreign Application Priority Data

Jun. 29, 2020 (JP) ..... JP2020-111398

(51) Int. Cl.
*H01J 61/52* (2006.01)
*H01J 61/06* (2006.01)

(52) U.S. Cl.
CPC ..... *H01J 61/526* (2013.01); *H01J 61/06* (2013.01)

(58) Field of Classification Search
CPC ..... H01J 61/526; H01J 61/06
See application file for complete search history.

(56) References Cited

FOREIGN PATENT DOCUMENTS

JP 2004-259639 A 9/2004

*Primary Examiner* — Donald L Raleigh
(74) *Attorney, Agent, or Firm* — Studebaker & Brackett PC

(57) ABSTRACT

A short-arc discharge lamp includes a pair of electrodes disposed facing each other inside a light-emitting tube, a scale-like structure being formed on an outer surface of at least one electrode of the pair of electrodes, and a coating film covering the outer surface on which the scale-like structure is formed. The scale-like structure includes a plurality of flaky protrusions protruding from the outer surface in a direction inclined with respect to a normal direction of the outer surface, each flaky protrusion having a front surface whose angle formed with the outer surface is an obtuse angle and a back surface whose angle formed with the outer surface is an acute angle. The coating film contains at least one of metal oxides, metal carbides, metal borides, metal silicides, and metal nitrides. A part of the coating film enters a space sandwiched between the back surface and the outer surface.

4 Claims, 8 Drawing Sheets

| | TAPE PEELING TEST | TEMPERATURE RISING/FALLING REPETITION TEST |
|---|---|---|
| COMPARATIVE EXAMPLE 1 | A | — |
| COMPARATIVE EXAMPLE 2 | B | C |
| EXAMPLE 1 | B | D |

SHORT-ARC DISCHARGE LAMP

CROSS REFERENCES TO RELATED APPLICATIONS

The present invention contains subject matter related to Japanese Patent Application No. 2020-111398 filed in the Japan Patent Office on Jun. 29, 2020, the entire contents of which are incorporated herein by reference.

TECHNICAL FIELD

The present invention relates to a short-arc discharge lamp, and more particularly to a short-arc discharge lamp in which a heat radiation layer is formed on an outer surface of an electrode in order to lower an electrode temperature particularly when the lamp is turned on.

BACKGROUND ART

For example, a short-arc discharge lamp (hereinafter, also simply referred to as "lamp") is used as a light source in an exposure apparatus used in a process of manufacturing a semiconductor element, a liquid crystal display element, or the like, or in various types of projectors. The short-arc discharge lamp is configured such that an anode and a cathode are arranged in a light-emitting tube so as to face each other, and a light-emitting substance such as mercury or xenon gas is sealed in the light-emitting tube.

In such a short-arc discharge lamp, it is known that since a thermal load applied to the anode is high when the lamp is turned on, evaporation of an electrode material due to overheating of the anode or the like occurs, and the resulting evaporated material adheres to an inner wall of the light-emitting tube so that light transmittance decreases, that is, so-called blackening occurs.

In order to solve such a problem, a technique for suppressing a temperature rise of an electrode by forming a heat radiation layer on an electrode surface is known, and Patent Document 1 below discloses a lamp in which a heat radiation layer containing at least one metal oxide is formed on an outer surface of the electrode except for the vicinity of a tip of the electrode.

Such a heat radiation layer has such a problem that it is difficult for the heat radiation layer to adhere to the electrode surface at the time of manufacturing, and the heat radiation layer is likely to be peeled off. In particular, a ceramic such as a metal oxide is stable even at a high temperature, and thus this problem remarkably occurs.

While a thermal expansion coefficient of tungsten constituting the electrode is $4.5\times10^{-6}$/K, for example, the thermal expansion coefficient of zirconium oxide ($ZrO_2$) constituting the heat radiation layer is $10.5\times10^{-6}$/K; thus, there is a large difference between these thermal expansion coefficients, and there is such a problem that the heat radiation layer may be peeled off due to expansion and contraction of the electrode caused by turning on and off the lamp.

As a solution to such a problem, attempts have been made to increase unevenness of the electrode surface by blast treatment or the like, and to increase peeling strength by an anchor effect.

PRIOR ART DOCUMENTS

Patent Document

Patent Document 1: JP-A-2004-259639

SUMMARY OF THE INVENTION

Problems to be Solved by the Invention

However, the unevenness formed by groove processing by cutting of the electrode surface, blast processing, or the like is merely a depression on the electrode surface, and although there is some anchor effect against the horizontal force with respect to the electrode surface, the anchor effect against the peeling force in a normal direction of the electrode surface cannot be said to be strong, and peeling may occur.

In view of the above problems, an object of the present invention is to provide a short-arc discharge lamp in which a pair of electrodes is disposed inside a light-emitting tube so that the electrodes face each other, and a heat radiation layer is formed on an outer surface of at least one electrode of the pair of electrodes, the short-arc discharge lamp having a long life, having excellent heat radiation ability, and being free from film peeling.

Means for Solving the Problems

A short-arc discharge lamp according to the present invention includes a pair of electrodes disposed facing each other inside a light-emitting tube, a scale-like structure being formed on an outer surface of at least one electrode of the pair of electrodes, and a coating film covering the outer surface on which the scale-like structure is formed. The scale-like structure includes a plurality of flaky protrusions protruding from the outer surface in a direction inclined with respect to a normal direction of the outer surface, each flaky protrusion having a front surface whose angle formed with the outer surface is an obtuse angle and a back surface whose angle formed with the outer surface is an acute angle. The coating film contains at least one of metal oxides, metal carbides, metal borides, metal silicides, and metal nitrides. A part of the coating film enters a space sandwiched between the back surface and the outer surface.

According to this configuration, since the outer surface of the electrode is covered with the coating film (heat radiation layer) having a high emissivity and containing at least one of metal oxides, metal carbides, metal borides, metal silicides, and metal nitrides, the electrode is excellent in thermal emission. Since a part of the coating film enters the space sandwiched between the back surface of the flaky protrusion and the outer surface of the electrode, an anchor effect against a force for peeling the coating film in the normal direction of the outer surface can be effectively obtained, so that the short-arc discharge lamp of the present invention has a long life without causing film peeling.

In the short-arc discharge lamp of the present invention, the outer surface on which the scale-like structure is formed may be an outer peripheral surface of the electrode having a cylindrical body. The protrusion may protrude in a direction inclined in a circumferential direction of the electrode with respect to the normal direction of the outer peripheral surface. The coating film may have a film thickness of 5 μm or more and 200 μm or less.

BRIEF DESCRIPTION OF THE DRAWINGS

FIG. 8 is a diagram schematically illustrating a state of lathe processing;

FIG. 9 is an evaluation result of examples and the like; and

MODE FOR CARRYING OUT THE INVENTION

Figure 1:
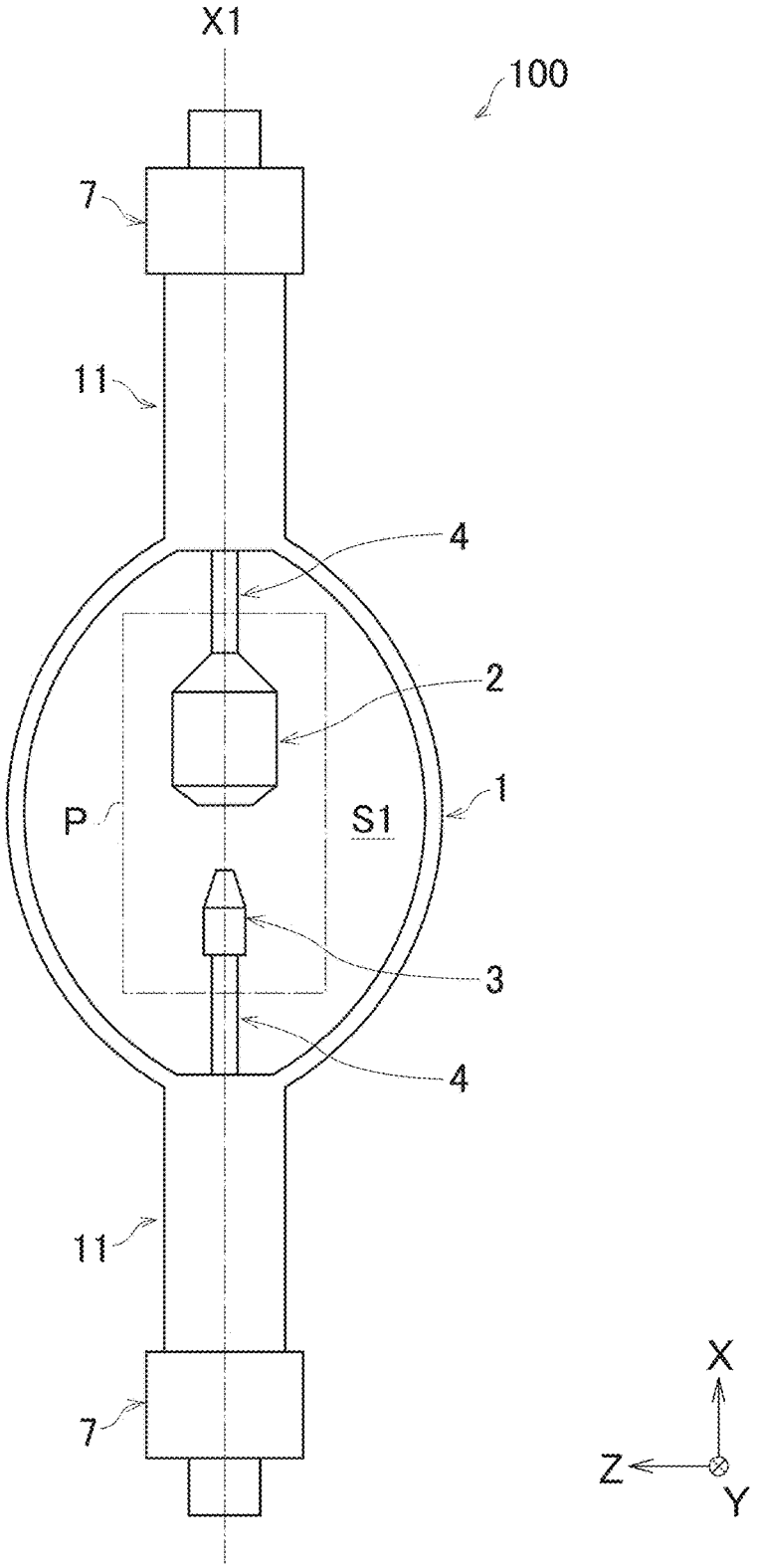
FIG. 1 is an explanatory diagram illustrating a configuration of a short-arc discharge lamp according to the present embodiment.

An embodiment of a short-arc discharge lamp according to the present invention will be described with reference to the drawings. The following drawings are schematically illustrated, the dimensional ratio in the drawings do not necessarily coincide with the actual dimension ratio, and the dimensional ratios do not necessarily coincide between the drawings.

Hereinafter, description will be made with reference to an XYZ coordinate system as appropriate. In the present specification, in a case where positive and negative directions are distinguished when a direction is expressed, the directions are described with positive and negative signs, such as "+X direction" and "−X direction". When a direction is expressed without distinguishing the positive and negative directions, the direction is simply described as "X direction". That is, in the present specification, a simple notation of the "X direction" encompasses both of the "+X direction" and the "−X direction" The same applies to the Y direction and the Z direction.

FIG. 1 is an explanatory diagram illustrating a configuration of the short-arc discharge lamp according to the present embodiment. A short-arc discharge lamp 100 (hereinafter, referred to as the "lamp 100") includes a light-emitting tube 1, an anode 2 and a cathode 3 arranged inside the light-emitting tube 1 so as to face each other, and lead rods 4 each supporting the anode 2 and the cathode 3.

The lamp 100 of the present embodiment is a large lamp used in an exposure apparatus or the like used in a process of manufacturing a semiconductor element, a liquid crystal display element, or the like, and has a rated power of, for example, 2 kW to 35 kW.

The light-emitting tube 1 is formed by inflating a center of a glass tube. The light-emitting tube 1 is a region of a glass tube whose inner diameter increases from both ends in the X direction toward the center. An outer shape of the light-emitting tube 1 is a sphere shape or an elliptical sphere shape.

The light-emitting tube 1 has a pair of sealed tube portions 11 continuously extending in opposite directions from both ends in the X direction of the light-emitting tube 1. The light-emitting tube 1 is formed integrally with the sealed tube portion 11 by, for example, quartz glass. Central axes of the pair of sealed tube portions 11 overlap each other and are indicated by an axis X1 in FIG. 1.

A light-emitting space S1 is formed inside the light-emitting tube 1. In addition to a light-emitting substance such as mercury, a startup assist buffer gas such as argon gas or xenon gas is appropriately sealed in the light-emitting space S1.

The anode 2 and the cathode 3 are arranged inside the light-emitting tube 1 so as to face each other in the X direction. In the present embodiment, the short-arc discharge lamp is a discharge lamp in which the anode 2 and the cathode 3 are arranged to face each other with an interval of 40 mm or less (value at normal temperature without thermal expansion). In the present embodiment, the anode 2 is formed of tungsten, and the cathode 3 is formed of thorium oxide tungsten.

The anode 2 and the cathode 3 each are connected to the lead rods 4 that extend in the X direction in the sealed tube portion 11. The anode 2 and the cathode 3 each are fixed to the tip of the lead rods 4. A central axis of the lead rods 4 may overlap with the axis X1. The lead rods 4 are made of a material containing a high melting point metal such as tungsten.

Bases 7 each cover a side of the sealed tube portion 11, the side being located away from the anode 2 and the cathode 3. Each of the base 7 is electrically connected to the lead rod 4.

Figure 2:
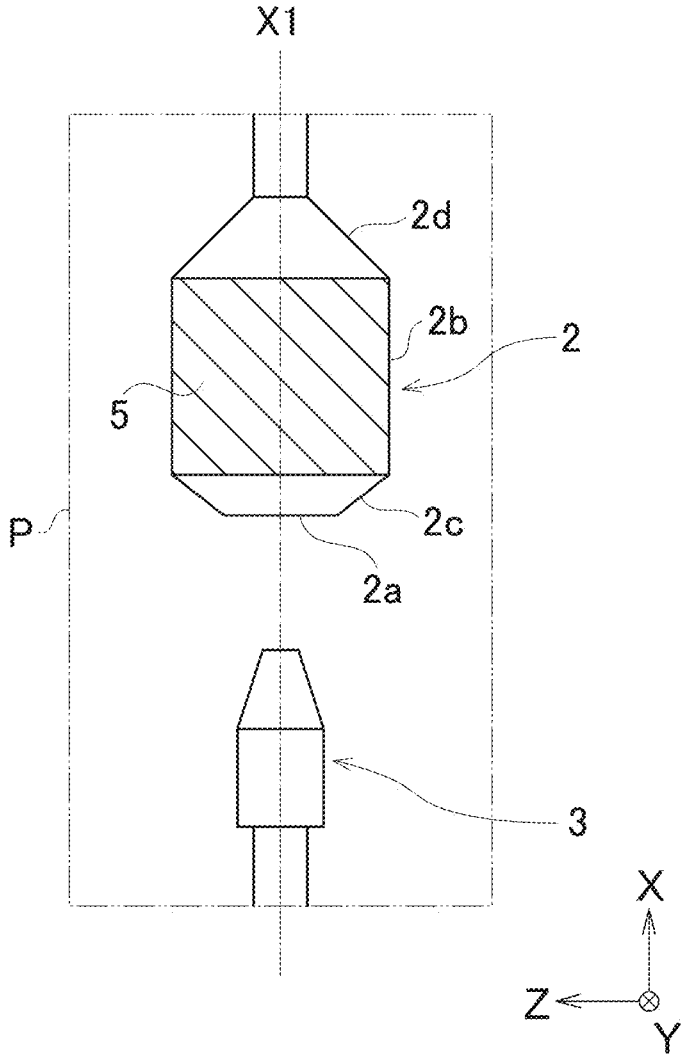
FIG. 2 is an enlarged view of a P region of the short-arc discharge lamp illustrated in FIG. 1.

FIG. 2 is an enlarged view of a P region of the lamp 100 illustrated in FIG. 1. A coating film 5 as a heat radiation layer is provided on an outer surface of the anode 2. Here, the outer surface of the anode 2 is an outer surface excluding a tip surface 2*a* facing the cathode 3. Since a temperature of the tip surface 2*a* of the anode 2 may rise to a temperature equal to or higher than the melting point of the coating film 5 when the lamp 100 is turned on, the coating film 5 is not provided on the tip surface 2*a* of the anode 2 in the present embodiment. In the present embodiment, although the coating film 5 is provided on an outer peripheral surface 2*b* of a cylindrical body centered on the axis X1 in the outer surface of the anode 2, the coating film 5 may also be provided on a tapered surface 2*c* located between the outer peripheral surface 2*b* and the tip surface 2*a*. In addition, the coating film 5 may be provided on a rear tapered surface 2*d* located on a +X side of the outer peripheral surface 2*b* of the anode 2.

As a material of the coating film 5, a melting point, a vapor pressure, an emissivity, a thermal expansion coefficient, and the like are important. In order to lower the temperature of the anode 2, the coating film 5 is preferably formed of a material having a high emissivity so as to increase an amount of heat radiation. That is, the coating film 5 may be a high radiation film for improving heat radiation ability.

The material of the coating film 5 includes at least one of a metal oxides, a metal carbides, a metal borides, a metal silicides, and a metal nitrides. As the material of the coating film 5, a material having a melting point of 2000° C. or higher can be suitably used, and examples thereof include aluminum oxide ($Al_2O_3$), zirconium oxide ($ZrO_2$), zirconium carbide (ZrC), zirconium boride ($ZrB_2$), tantalum silicide ($TaSi_2$), and zirconium nitride (ZrN).

Figure 3A:
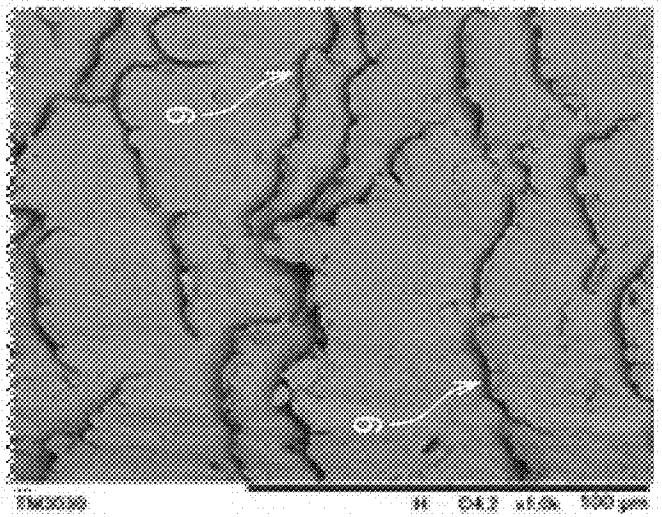
FIG. 3A is an enlarged photograph of an outer surface of an anode before a coating film is formed (image of surface)
Figure 3B:
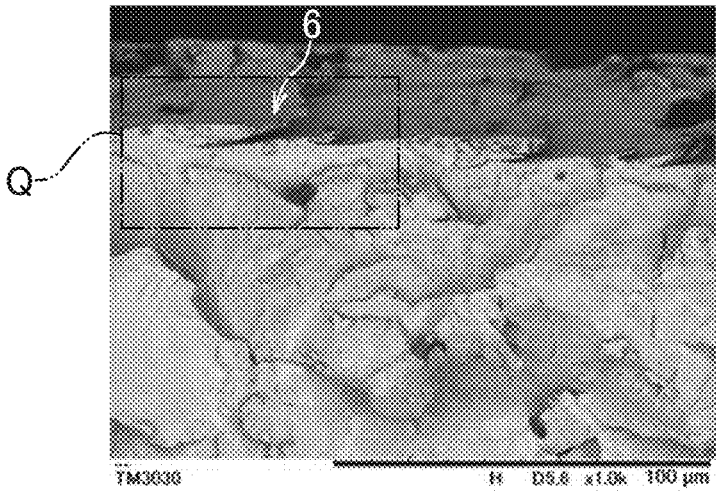
FIG. 3B is an enlarged photograph of the outer surface of the anode before the coating film is formed (image of cross section)

FIGS. 3A and 3B are enlarged photographs (SEM images) of the outer surface of the anode 2 before the coating film 5 is formed, FIG. 3A is a surface image, and FIG. 3B is a cross-sectional image. A fine scale-like structure is formed on the outer surface of the anode 2. The scale-like structure is a structure in which a surface state of the outer surface is scaly, and includes a plurality of flaky protrusions 6. The flaky protrusion 6 protrudes from the outer surface of the anode 2 in a direction inclined with respect to a normal direction of the outer surface of the anode 2.

Figure 4:
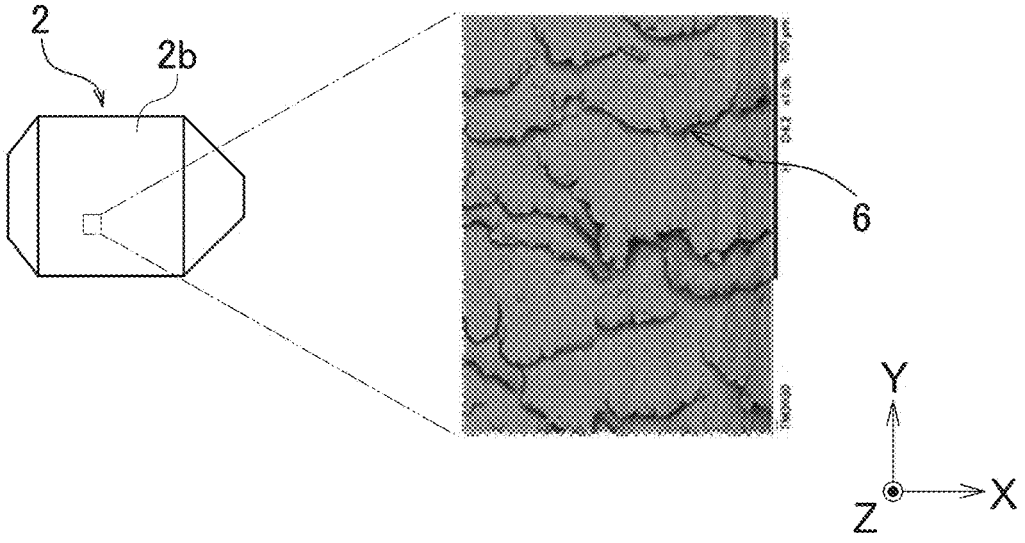
FIG. 4 is a view illustrating a forming direction of a flaky protrusion.
Figure 5A:
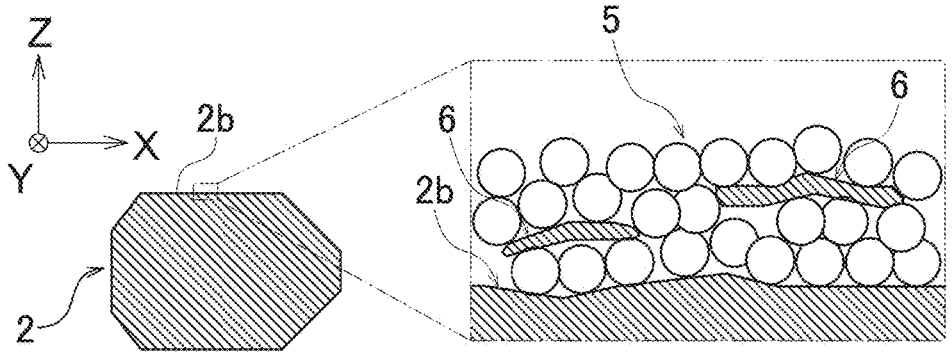
FIGS. 5A, 5B and 5C are enlarged views of a scale-like structure.
Figure 5B:
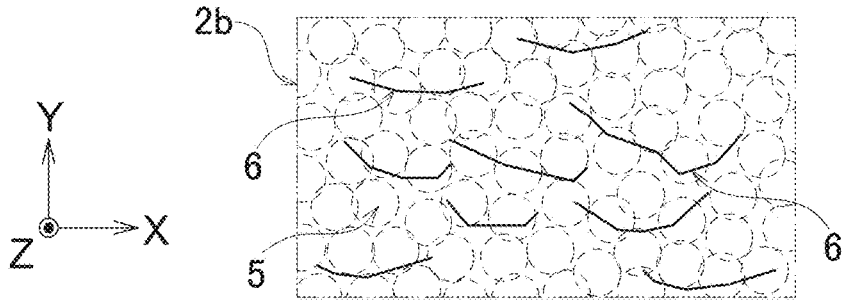
Figure 5C:
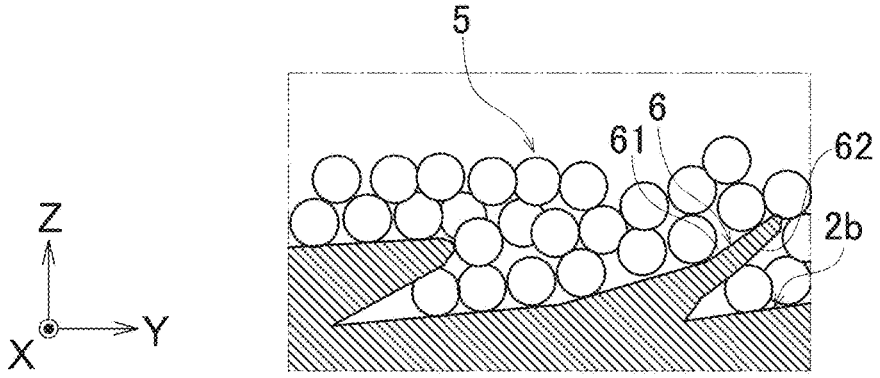

FIG. 4 is a view illustrating a forming direction of the flaky protrusion 6. FIGS. 5A, 5B and 5C are enlarged views of the scale-like structure. FIG. 5A is an enlarged view of an axial cross section of the anode 2, FIG. 5B is an enlarged view of a plane of the anode 2, and FIG. 5C is an enlarged view of a circumferential cross section of the anode 2. In FIGS. 5A, 5B and 5C, the axial direction of the anode 2 is defined as the X direction, a circumferential direction (tangential direction in the circumferential direction) is defined as the Y direction, and the normal direction is defined as the Z direction.

The flaky protrusion 6 is formed by peeling-up an electrode surface at an acute angle by lathe processing, for example. More specifically, the flaky protrusion 6 is formed by pressing a cutting tool against the outer peripheral surface 2*b* while rotating the anode 2 in the circumferential direction. As illustrated in FIG. 4, the plurality of flaky protrusions 6 are all formed so as to protrude in the same direction. The flaky protrusion 6 of the present embodiment protrudes in a direction inclined in the circumferential direction (Y direction) of the anode 2 with respect to the normal direction (radial direction of the outer peripheral surface 2*b*) of the outer peripheral surface 2*b*.

The flaky protrusion 6 has a front surface 61 whose angle formed with the outer peripheral surface 2*b* is an obtuse angle and a back surface 62 whose angle formed with the outer peripheral surface 2*b* is an acute angle (see FIG. 5C). The angle formed with the outer peripheral surface 2*b* is an angle formed with the tangential direction of the outer peripheral surface 2*b* at a portion where the flaky protrusion 6 is located when the outer peripheral surface 2*b* has a curved surface shape.

Figure 6:
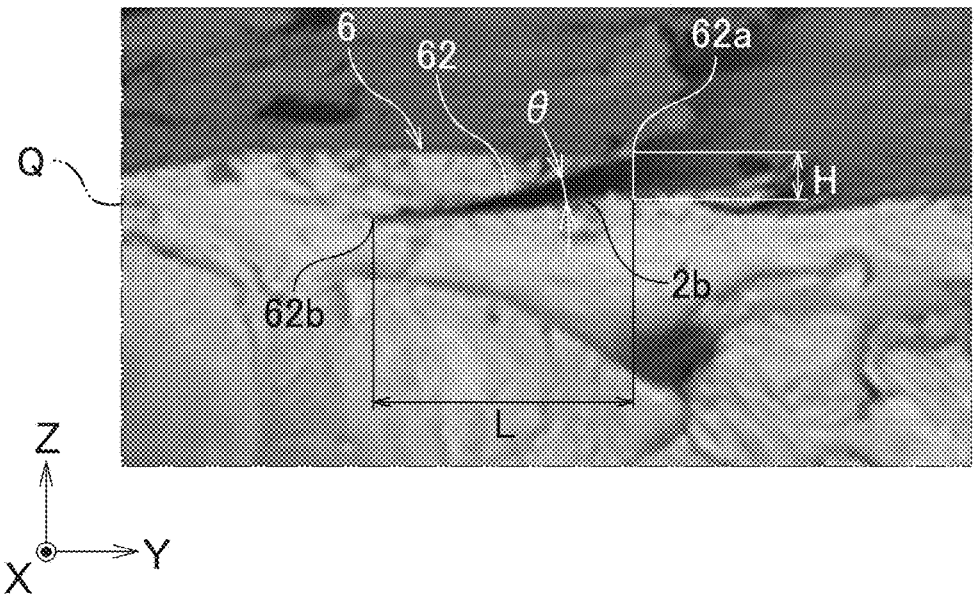
FIG. 6 is an enlarged view of a Q region of the anode illustrated in FIG. 3B.

FIG. 6 is an enlarged view of a Q region of the anode 2 illustrated in FIG. 3B. An angle θ formed by the back surface 62 of the flaky protrusion 6 and the outer peripheral surface 2*b* is 5 to 30°.

A height H from the outer peripheral surface 2*b* to a protruding end 62*a* of the back surface 62 of the flaky protrusion 6 is 3 to 15 μm.

A protrusion length L of the back surface 62 of the flaky protrusion 6 as viewed from the normal direction (Z direction) of the outer peripheral surface 2*b* is 10 to 50 μm. The protrusion length L is a length in the Y direction from a base end 62*b* to the protruding end 62*a* of the back surface 62.

A width of the flaky protrusion 6 in the X direction is about 10 μm at the minimum and about 0.4 mm at the maximum.

The coating film 5 is formed by dispersing particles (for example, particles of zirconium oxide ($ZrO_2$) having a particle size of 10 μm or less) of a material constituting the coating film 5 in a solvent (for example, solvent composed of nitrocellulose and butyl acetate), applying the mixture to the outer peripheral surface 2*b* of the anode 2 with a brush, drying the coating at 150° C. for 30 minutes, and then performing heat treatment at 1900° C. for 120 minutes in a vacuum atmosphere. At the time of this application, the particles constituting the coating film 5 enter a gap between the back surface 62 of the flaky protrusion 6 and the outer peripheral surface 2*b* (in FIGS. 5A, 5B and 5C, the particles of the coating film 5 are schematically shown by circles). As a result, as illustrated in FIG. 5C, the coating film 5 is formed in a state where a part thereof enters a space sandwiched between the back surface 62 and the outer peripheral surface 2*b*. When the flaky protrusions 6 partially overlap each other in the Z direction, a part of the coating film 5 may enter a gap between the back surface 62 of one of the flaky protrusions 6 and the front surface 61 of the other flaky protrusion 6. A film thickness of the coating film 5 is preferably 5 μm or more and 200 μm or less. When the film thickness of the coating film 5 is thin, a sufficient emissivity cannot be obtained, and when the film thickness is thick, the coating film 5 is likely to be peeled off. The film thickness of the coating film 5 of the present embodiment is about 10 to 50 μm.

An average particle size of the particles of the material constituting the coating film 5 is preferably 1 to 10 μm. For example, a plurality of materials having different average particle sizes may be used, such as a combination of particles having an average particle size of 2 μm and particles having an average particle size of 5 μm.

Figure 7:
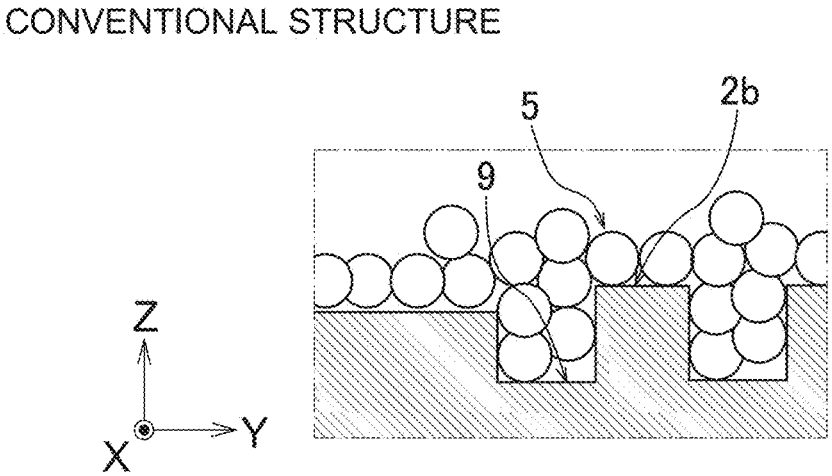
FIG. 7 is an enlarged view of a circumferential cross section of a conventional structure.

The anchor effect by the scale-like structure having the plurality of flaky protrusions 6 will be described with reference to FIGS. 5A, 5B and 5C. FIG. 7 is an explanatory diagram of the anchor effect by a conventional structure (structure formed by sandblasting), and corresponds to the enlarged view of the circumferential cross section of FIG. 5C. A cross section of a depression 9 of the conventional structure is similar in the Y direction.

As illustrated in FIG. 5A, in the scale-like structure, a height at which the flaky protrusion 6 is peeled-up is not uniform and varies. Thus, similarly to the conventional structure illustrated in FIG. 7, the particles are restrained in the X direction.

As illustrated in FIG. 5B, the flaky protrusions 6 are continuously provided in the Y direction, and there are variations in the height at which the flaky protrusion 6 is peeled-up. Thus, similarly to the conventional structure illustrated in FIG. 7, the particles are restrained in the Y direction.

In addition, as illustrated in FIG. 5C, the particles enter the gap between the back surface 62 of the flaky protrusion 6 and the outer peripheral surface 2*b*, and the particles are bonded to each other, so that the particles are restrained in the Z direction. On the other hand, in the conventional structure illustrated in FIG. 7, although the anchor effect in the X direction and the Y direction (the axial direction and the circumferential direction of the anode 2) can be obtained as described above, a restraining force in the Z direction (normal direction) is weak, and a strong anchor effect cannot be obtained.

As described above, in the scale-like structure of the present invention, a stronger anchor effect can be obtained than in the conventional structure, and peeling strength of the coating film 5 provided on the outer surface of the anode 2 (the outer peripheral surface 2*b* in the present embodiment) is increased.

EXAMPLE

Hereinafter, examples which specifically show a construction and effect of the present invention will be explained below. The evaluations in examples were performed by the following tests.

(1) Tape Peeling Test

As an evaluation of adhesiveness of the coating film 5 after sintering, a peeling adhesion strength test was performed in accordance with Japanese Industrial Standards K 6854. Specifically, first, a cellophane adhesive tape (CT 405 AP manufactured by Nichiban Co., Ltd., adhesive force: 3.93 N/10 mm) having a width of 15 mm was attached in the circumferential direction of the outer peripheral surface 2*b* of the anode 2 having a diameter of φ 29 mm after the coating film 5 was applied and sintered, and rapidly peeled off, and whether or not the coating film 5 was adhered to an adhesive surface of the tape was visually confirmed.

(2) Temperature Rising/Falling Repetition Test

As the evaluation of the adhesiveness of the coating film 5 to the expansion and contraction of the electrode due to heat, a periodic on/off lighting test in which the lamp 100 mounted with the anode 2 in which the coating film 5 was applied and sintered was turned on at a rated power of 6000 W for 1 hour and then turned off for 30 minutes was repeated 50 times, and peeling of the coating film 5 was visually confirmed. At this time, a portion closest to the tip surface 2*a* in the coating film 5 on the outer peripheral surface 2*b* of the anode 2 reaches about 2,000° C.

Example 1

Figures 8, 9:
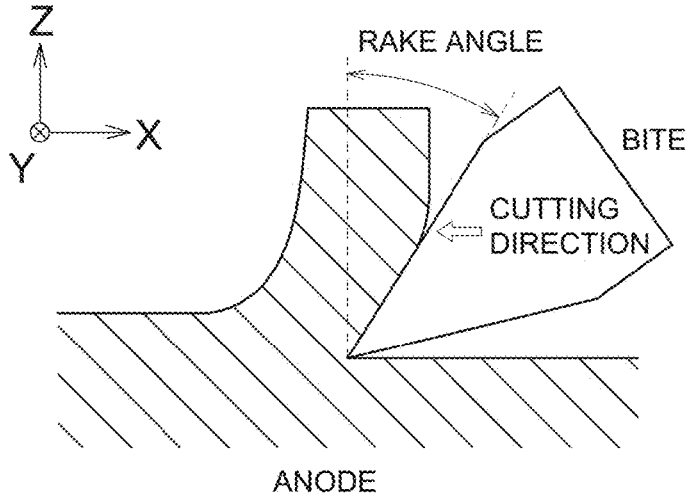

The anode 2 having the following specifications was prepared and designated as example 1. The scale-like structure of the outer peripheral surface 2*b* of the anode 2 was formed by lathe processing. In the lathe processing, cutting was performed under the following conditions using a hard metal alloy bite (cutting tip). FIG. 8 is a diagram schematically illustrating a state of lathe processing. In the lathe processing, cutting is performed by moving the bite in the axial direction while rotating the anode 2 in the circumferential direction. The material of the coating film 5 was $ZrO_2$ (zirconia). The film thickness of the formed coating film 5 is about 50 μm.

Bite (cutting tip): made of hard metal alloy, nose R (Round process of tip distal end) 0.4 mm Rotation speed of lathe: 346 rpm Cutter thrusting amount: 50 μm Rake angle: 20° to 30°

Comparative Example 1

The anode 2 having no fine unevenness formed on the outer peripheral surface 2*b* was designated as Comparative example 1. The material and film thickness of the coating film 5 were the same as those in example 1.

Comparative Example 2

The anode 2 on which an alumina powder was sprayed to the outer peripheral surface 2*b* to form fine unevenness (sandblasting was performed) was designated as Comparative example 2. This simulates the structure described above with reference to FIG. 7. The material and film thickness of the coating film 5 were the same as those in example 1.

The evaluation results by the above test are illustrated in FIG. 9. A case where the coating film 5 was adhered to the adhesive surface of the tape in the tape peeling test was evaluated as "A", and a case where the coating film 5 was not adhered was evaluated as "B". A case where the coating film 5 was peeled in the temperature rising/falling repetition test was evaluated as "C", and a case where the coating film 5 was not peeled was evaluated as "D".

As illustrated in FIG. 9, in Comparative example 1, the adhesion of the coating film 5 to the adhesive surface of the tape was observed in the tape peeling test. Since the result of the tape peeling test was evaluated as "A", the temperature rising/falling repetition test was not performed.

In Comparative example 2, although the result of the tape peeling test was evaluated as "B", the peeling of the coating film 5 was visually observed in the temperature rising/falling repetition test. Furthermore, in Comparative example 2, in a state where the lamp 100 was horizontally turned on, foreign matter due to the peeling of the coating film 5 was confirmed inside the light-emitting tube 1.

In example 1, the peeling of the coating film 5 did not occur in either of the tape peeling test or the temperature rising/falling repetition test.

Specific constructions according to the present invention are not limited to the above embodiments described above with reference to the drawings. The scope of the present invention is not encompassed by the above explanations of the embodiment but particularly pointed out by the claims, and the equivalents of the claim recitations as well as all the modifications within the scope of the claims fall within the scope of the present invention.

The structure adopted in each of the above embodiments can be adopted in any other embodiment. Specific configurations of parts are not restricted only to those in the above-described embodiments, and various modifications are possible within the scope of the gist of the present invention. In addition, the constituents, methods, and the like of various modified examples described below may be arbitrarily selected and employed as the constituents, methods, and the like of the above-described embodiments.

(1) In the above embodiment, although the coating film 5 is provided only on the outer surface of the anode 2, a coating film may also be provided on the outer surface of the cathode 3, or a coating film may be provided only on the outer surface of the cathode 3.

Figure 10:
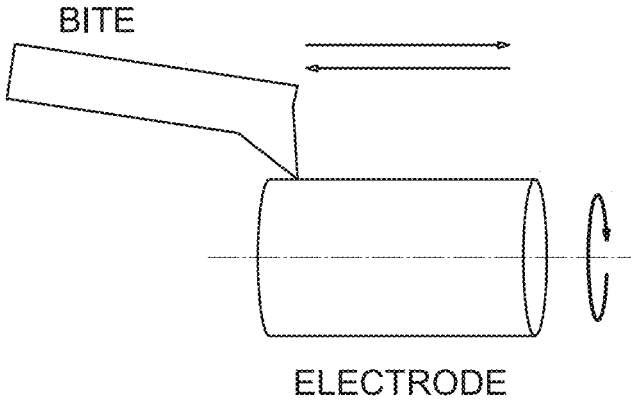
FIG. 10 is a diagram schematically illustrating a state of shaper processing.

(2) In the above embodiment, the scale-like structure is formed by lathe processing, but the invention is not limited thereto. For example, the scale-like structure may be formed by shaper processing. As illustrated in FIG. 10, in the shaper processing, cutting is performed by moving the bite in the axial direction while rotating the electrode at a predetermined pitch in the circumferential direction. The flaky protrusion formed by the shaper processing protrudes in a direction inclined in the axial direction of the electrode with respect to the normal direction of the outer peripheral surface.

What is claimed is:

1. A short-arc discharge lamp comprising:

a pair of electrodes disposed facing each other inside a light-emitting tube;

a scale-like structure being formed on an outer surface of at least one electrode of the pair of electrodes; and a coating film covering the outer surface on which the scale-like structure is formed, wherein the scale-like structure including a plurality of flaky protrusions protruding from the outer surface in a direction inclined with respect to a normal direction of the outer surface, each flaky protrusion having a front surface whose angle formed with the outer surface is an obtuse angle and a back surface whose angle formed with the outer surface is an acute angle, the coating film containing at least one of metal oxides, metal carbides, metal borides, metal silicides, and metal nitrides, and a part of the coating film entering a space sandwiched between the back surface and the outer surface.

2. The short-arc discharge lamp according to claim 1, wherein the outer surface on which the scale-like structure is formed is an outer peripheral surface of the electrode having a cylindrical body.

3. The short-arc discharge lamp according to claim 2, wherein the protrusion protrudes in a direction inclined in a circumferential direction of the electrode with respect to a normal direction of the outer peripheral surface.

4. The short-arc discharge lamp according to claim 1, wherein the coating film has a film thickness of 5 μm or more and 200 μm or less.

* * * * *